United States Patent [19]

Kato

[11] Patent Number: 4,827,309

[45] Date of Patent: May 2, 1989

[54] LIQUID DEVELOPING APPARATUS WITH A PLURALITY OF FOUNTAIN AND DISCHARGE SLITS

[75] Inventor: Keishi Kato, Kanagawa, Japan

[73] Assignee: Fuji Photo Film Co., Ltd., Kanagawa, Japan

[21] Appl. No.: 24,200

[22] Filed: Mar. 10, 1987

[30] Foreign Application Priority Data

Mar. 10, 1986 [JP] Japan ..... 61-52216

[51] Int. Cl.[4] ..... G03G 15/10

[52] U.S. Cl. ..... 355/256; 118/659; 118/660; 118/662; 354/317; 354/325

[58] Field of Search ..... 355/10, 15, 14 D, 3 R, 355/3 BE; 354/317, 325; 118/659, 660, 661, 662, 627-629; 239/553.3, 553, 553.5, 590.3, 590, 590.5

[56] References Cited

U.S. PATENT DOCUMENTS

| | | | |
|---|---|---|---|
| 2,755,851 | 7/1956 | Dow et al. | 239/553 |
| 2,775,773 | 1/1957 | Marsh | 239/590.3 |
| 2,865,830 | 12/1958 | Zoldas | 239/553.3 |
| 3,557,752 | 1/1971 | Hakanson | 118/662 X |
| 3,752,119 | 8/1973 | Matkan | 355/10 X |
| 3,952,702 | 4/1976 | Levy | 355/10 X |
| 3,957,016 | 5/1976 | Yamada et al. | 355/10 X |
| 4,179,210 | 12/1979 | Bestenreiner et al. | 355/10 |
| 4,294,018 | 10/1981 | Kumazawa et al. | 239/553.3 |
| 4,480,907 | 11/1984 | Vackier | 355/10 |

*Primary Examiner*—Fred L. Braun
*Assistant Examiner*—John G. Smith
*Attorney, Agent, or Firm*—Sughrue, Mion, Zinn, Macpeak & Seas

[57] ABSTRACT

A developing head is provided under a latent image carrier in the form of a rotating drum or a horizontally moving plate. The developing head includes a plurality of fountain slits and discharge slits arranged alternately in parallel to each other and extending laterally. A liquid developer jets out of supply openings provided in a hollow pipe member inserted in each cylindrical developer guide provided under the fountain slits and connected with the slits. The liquid developer jets move upward to the latent image carrier through the fountain slits and are discharged through the discharge slits located on both sides of the fountain slits.

7 Claims, 3 Drawing Sheets

LIQUID DEVELOPING APPARATUS WITH A PLURALITY OF FOUNTAIN AND DISCHARGE SLITS

BACKGROUND OF THE INVENTION

1. Field of the Invention

This invention relates to a liquid developing apparatus for developing an electrostatic latent image recorded by an electrophotographic method or an electrostatic recording method by use of a liquid developer.

2. Description of the Prior Art

There have been proposed various kinds methods of applying a liquid developer to the surface of a latent image carrier. They are roughly classified into the following four kinds methods of: (1) immersion development in which the latent image carrier is immersed in a liquid developer, (2) shower development in which the latent image carrier is exposed to a shower of liquid developer, (3) roll development in which a liquid developer is supplied to the surface of a developing roller capable of holding the liquid developer and the developing roller is put into contact with the surface of the latent image carrier, and (4) jet development in which a jet of liquid developer is applied to the surface of the latent image carrier.

In the development of an electrostatic latent image recorded by an electrophotographic or electrostatic recording method, it is a general demand to develop a high quality image without uneven development at as high a speed as possible. The aforesaid known developing methods have drawbacks as mentioned hereinbelow, respectively.

In the immersion development, a development elecrode is generally used in order to reduce an edge effect. However, since the latent image carrier is simply immersed in the liquid developer and there is no specific means for applying a large amount of fresh liquid developer to the surface of the latent image, the developing speed is low and there is a tendency that the image is unevenly developed.

In the shower development, it is difficult to supply a large amount of liquid developer uniformly to the surface of the latent image.

In the roll development, it is difficult to uniformly apply the liquid developer to the whole surface of the developing roller. Further, in case of developing the image with the developing roller pressed on the latent image carrier, the image is likely to be deformed by the contact with the roller. Furthermore, since the amount of the liquid developer applied to the latent image carrier is limited to the amount held by the developing roller, a large amount of the liquid developer cannot be applied.

In the jet development, it is possible to apply a large amount of liquid developer to the latent image carrier as compared with the above methods. Accordingly, this method is widely adopted. However, this method needs improvement in the uniform application of the large amount of liquid developer to the latent image carrier. There have been suggested various improvements in this connection, which are however still not sufficient to solve the problem.

In general, the development of an electrostatic latent image is conducted by use of a liquid developer in which toner particles having electric charge are dispersed in an insulating liquid. In order to obtain images of high quality with uniform development at a high developing speed, it is important to supply a large amount of liquid developer having uniform characteristics to the surface carrying the latent image as uniformly as possible. Nonuniform supply of the liquid developer will result in uneven development or lines in the developed image as often experienced.

Another important point in the liquid development for obtaining a uniform image is to remove the used liquid developer from the developing area as quickly as possible and to supply a fresh liquid developer thereto.

In more detail, in the development of an electrostatic latent image, charged toner particles dispersed in a carrier liquid stick to the surface of the latent image carrier. At this stage, particles contained in the liquid developer close to the surface of the latent image carrier stick to the surface with priority. Consequently, as the development advances, the charged particles in the liquid developer close to the surface of the latent image carrier are reduced in number and the composition or characteristics of the liquid developer close to the surface are changed from those of the fresh liquid developer before being used for development. In the development, since the latent image is developed while being moved at a speed relative to the liquid developer, the liquid developer having less number of charged particles moves to other parts of the latent image and is used for development again, where the development is conducted with a smaller number of charged toner particles resulting in uneven development.

It is preferable that the liquid developer used for developing a part of the electrostatic latent image not be supplied to other parts of the latent image for developing other parts as described above. It is, therefore, important that the liquid developer used for developing a part of the latent image is quickly removed from the surface of the latent image and a fresh liquid developer is supplied thereto. This is obviously effective also for accomplishing high speed development.

SUMMARY OF THE INVENTION

The primary object of the present invention is to provide a liquid developing apparatus in which a liquid developer having uniform characteristics is uniformly supplied to the surface of an electrostatic latent image and the liquid developer used for development, having changed its property, is quickly removed from the area close to the surface of the latent image, whereby a fresh liquid developer having uniform characteristics is supplied thereto.

Another object of the present invention is to provide a liquid developing apparatus in which uneven development is kept to a minimum and development can be carried out at a high speed.

The liquid developing apparatus in accordance with the present invention is characterized in that a plurality of fountain slits for providing upward fountains of liquid developer and a plurality of discharge slits for discharging used liquid developer are alternately arranged in parallel to each other, and hollow pipe members having openings for jetting out the liquid developer are provided under said fountain slits, whereby the liquid developer is uniformly supplied to the surface of the electrostatic latent image and the used liquid developer is quickly removed from the surface of the latent image effecting constant development by use of a uniform liquid developer.

DESCRIPTION OF THE PREFERRED EMBODIMENTS

Now the present invention will be described in detail with reference to preferred embodiments thereof as shown in the accompanying drawings.

Figure 1:
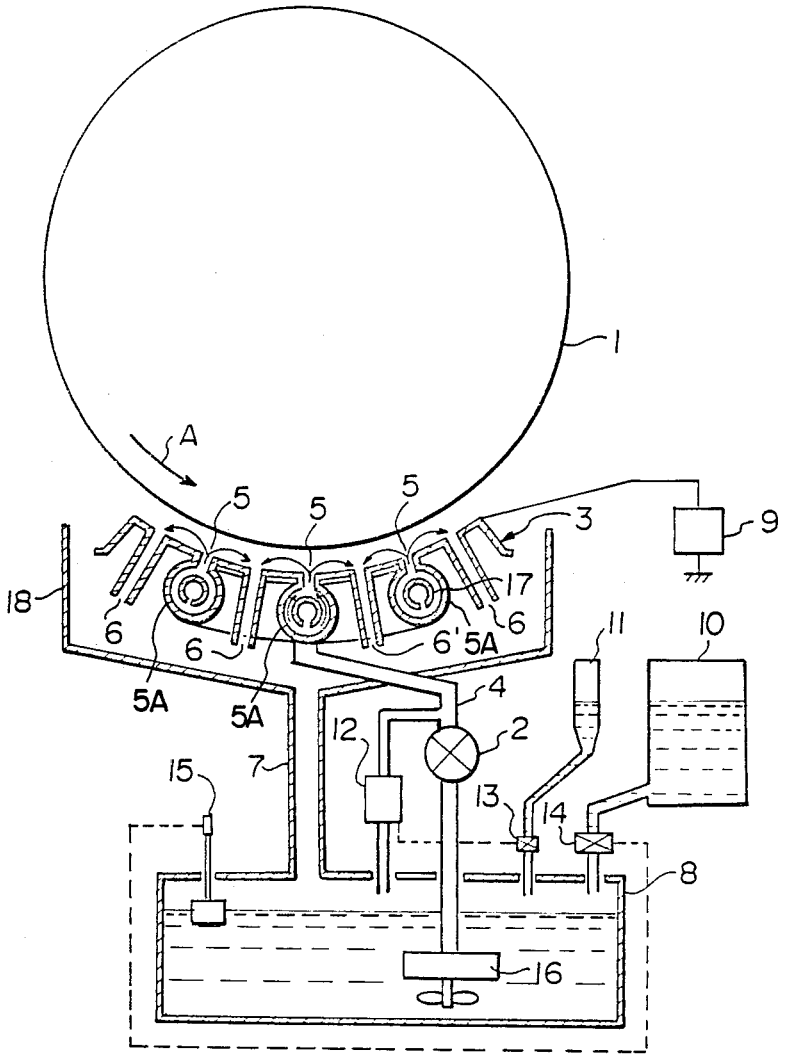
FIG. 1is a schematic diagram showing an embodiment of the liquid developing apparatus in accordance with the present invention.

FIG. 1 shows schematically an embodiment of the liquid developing apparatus in accordance with the present invention. Referring to FIG. 1, a photoconductive drum 1 rotatable in the direction of arrow A carrying an electrostatic latent image on the surface thereof is provided above a liquid developing apparatus according to the invention. A developing head 3 is connected with a pump 2 by way of a developer supply pipe 4, the pump 2 being connected with a suction portion 16 located in a liquid developer tank 8. The developing head 3 has a plurality of fountain slits 5 and developer discharge slits 6 alternately arranged in parallel. The fountain slits 5 provide fountains of liquid developer upwards toward the downwardly faced surface of the photoconductive drum 1 and the discharge slits 6 discharges the used liquid developer from the developing area between the surface of the drum 1 and the developing head 3. A chute 18 is provided under the developing head 3 to collect discharged developer and guide it to a return pipe 7 connected therewith.

Figure 2A:
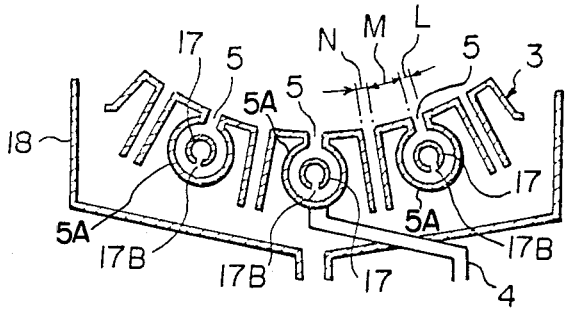
FIG. 2A is a fragmentary sectional view showing the liquid developer supply head employed in the present invention according to the embodiment shown in FIG. 1.

The fountain slits 5 are communicated with cylindrical developer guides 5A in which hollow pipe members 17 having developer supply openings 17B, FIG. 2A, are provided. The developing head 3 is electrically connected with a bias applying means 9.

The developing head 3 is provided close to the lower surface of the drum 1 so that the lower surface of the drum 1 is subjected to application of the liquid developer provided by the fountain slits 5 thereof. As the drum 1 rotates in the direction of arrow A, the latent image carried thereby is developed by the liquid developer, while the surface of the drum 1 is constantly exposed to a fresh liquid developer coming out of the fountain slits 5 arranged in parallel to the axis of rotation of the drum 1. The used liquid developer is discharged through the discharge slits 6 arranged between the fountain slits 5.

The liquid developer is stirred sufficiently in the developer tank 8 to provide uniform composition and property and is pumped up to the developing head 3 by the pump 2. After the liquid developer is used for developing the latent image carried by the drum 1, it is returned to the tank 8 by way of the chute 18 and the return pipe 7 and is stirred again in the tank 8. The tank 8 is provided with a concentration detector 12 which detects the concentration of the developer and a level detector 15 which detects and controls the level of the liquid developer in the tank 8. The concentration detector 12 is operatively connected with control valves 13 and 14 provided at the supply pipes of a dilute solution reservoir 10 and a concentrated solution reservoir 11, respectively, and controls the valves 13 and 14 to maintain the concentration of the developer at a predetermined concentration. The level detector 15 is connected with the control valve 14 to regulate the level of the liquid developer in the tank 8 by controlling the valve 14.

Figure 2B:
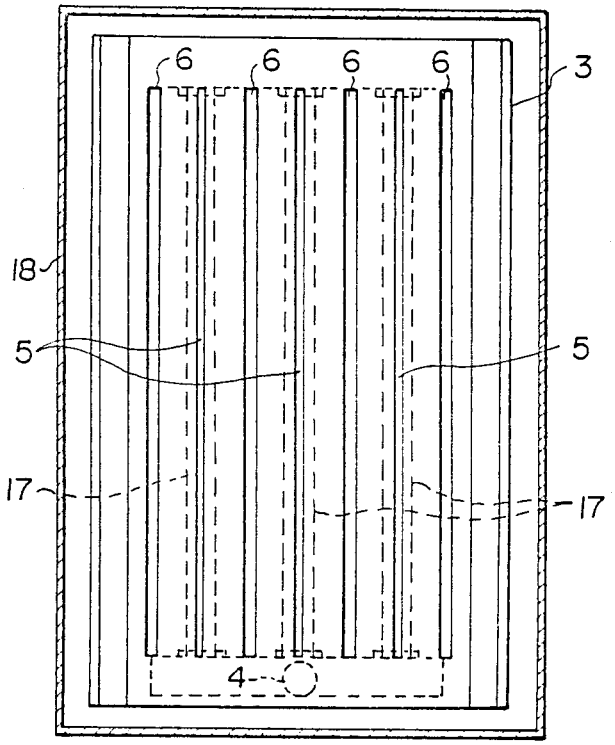
FIG. 2B is a top plan view showing the liquid developer supply head as shown in FIG. 2A.
Figure 2C:
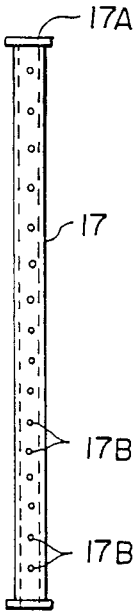
FIG. 2C is a bottom plan view of a hollow pipe member employed in the liquid developer supply head a shown in FIGS. 2A and 2B.

Now the performance of the developing head 3 will be described in further detail referring to FIGS. 2A to 2C. The liquid developer pumped up to the hollow pipe members 17 by way of the supply pipe 4 is jetted out of the supply openings 17B into the interior of the cylindrical developer guides 5A. The hollow pipe members 17 are provided at an end thereof with a closure plate 17A and communicated at the other end thereof with the supply pipe 4. The supply openings 17B are provided at changing intervals which increase from the supplying pipe side end to the closure plate side end so that the pressure and the amount of the liquid developer will become constant throughout the length of the pipe members 17. This is a measurement for the changing pressure of the jetted out liquid developer which changes from an end to the other due to the biased location of the supply pipe 4 connected thereto. Further, the supply openings 17B operate as a buffer for the fluctuation of the pressure and rate of the liquid developer pumped up by the pump 2. It will readily be noted that the supply openings 17B may be slits instead of the circular openings.

Hence, the liquid developer jetted out of the supply openings 17B of the hollow pipe members 17 is supplied to the developing area between the photoconductive drum 1 and the developing head 3 to develop the electrostatic latent image recorded on the drum 1. Since the pressure and the rate of the liquid developer is made equal from end to end along the hollow pipe members 17, a uniform supply of the liquid developer in the direction parallel to the axis of rotation of the drum 1 can be realized.

The liquid developer jetted out of the fountain slits 5 impinges upon the surface of the drum 1 and is split into two directions, upstream and downstream with respect to the direction of rotation of the drum 1, and advances along the surface of the drum 1 while developing the latent image.

The composition and characteristics, or property of the liquid developer, changes as the development advances. The liquid developer used for the development is quickly discharged through the discharge slits 6 provided on both sides of the fountain slits 5. Since the discharge slits 6 are provided close to and on both sides of the fountain slits 5, the liquid developer used and having changed its property can quickly be removed from the developing area. Accordingly, the development with the liquid development having a property substantially the same as that of a fresh liquid developer is possible, and the development can be conducted without uneven development.

Further, since the fountain slits 5 and the discharge slits 6 are provided alternately in parallel to each other and to the axis of rotation of the drum 1 and the development advances while the drum 1 is rotated, there is no uneven development also in the direction of rotation of the drum 1.

It will also be noted that the drum 1 may not be a photoconductive drum but may be any type of drum as long as it carries an electrostatic latent image.

The width and the interval of the slits 5 and 6 are determined preferably as follows. The width L of the fountain slits 5 ( See FIG. 2A ) should preferably be 0.1 to 5 mm, the interval M between the slits 5 and 6 should preferably be 2 to 5 times as large as the width L, and the width N of the discharge slits 6 should preferably be 1 to 3 times as large as the width L.

The developing head 3 is electrically connected with a bias means 9 and is made of electrically conductive material at least at the top face thereof so that the head 3 may function as a developing electrode or a bias electrode to ground the head or impart a bias voltage to the head for obtaining an image of high quality with a reduced edge effect or a fog.

Figure 3:
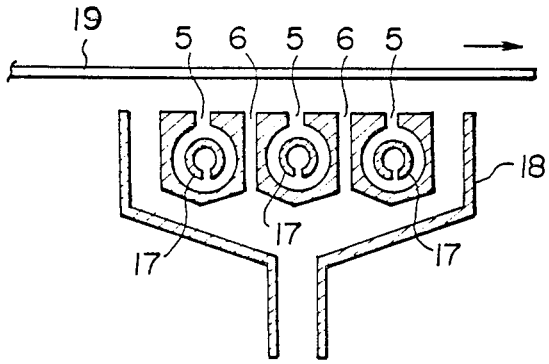
FIG. 3 is a schematic diagram showing another embodiment according to the present invention wherein the electrostatic latent image carrier is flat and horizontally fed.

In the above-described embodiment, the latent image is on a rotating drum 1. However, the latent image carrier may be a plate having a flat surface moving horizontally. One of such examples is shown in FIG. 3. The reference numeral 19 designates a latent image carrier having a flat surface and moving in a horizontal direction. All the elements shown in FIG. 3 designated by the same reference numerals as used before are equivalent to those shown in FIGS. 1 and 2A–2C, and accordingly the detailed description thereof is omitted here. As apparent from the drawing, this embodiment has the same results as those obtained in the afore-mentioned embodiment.

In the above-described embodiments of the present invention, the fountain slits and the discharge slits are arranged alternately in parallel to each other and to the axis of rotation of the drum. It will be noted, however, that the expression "in parallel" should be interpreted in a broad sense. Accordingly, it should be understood that the slits may not be precisely in parallel to each other but may be arranged substantially lateral to the direction of movement of the latent image carrier.

I claim:

1. A liquid developing apparatus of the type in which a latent image carrier having a latent image carrying surface for carrying an electrostatic latent image is moved with the latent image carrying surface faced downwardly and a liquid developer is applied upwardly to the latent image carrying surface from a developing head located under the latent image carrier, thereby developing the electrostatic latent image, characterized in that said developing head comprises a plurality of fountain slits from which the liquid developer jets out, and a plurality of discharge slits through which used liquid developer is discharged, said fountain slits and said discharge slits are arranged alternately in parallel to each other and extend laterally with respect to the direction of movement of the latent image carrying surface of said latent image carrier, wherein cylindrical developer guides are provided under said fountain slits and said fountain slits communicate with said cylindrical developer guides, hollow pipe members are provided within said cylindrical developer guides, said hollow pipe members having supply openings through which the liquid developer is jetted out, and wherein said supply openings face downwardly through which liquid developer is jetted out against the cylindrical developer guides for flow about the hollow pipe members and for further jetting upwardly from said fountain slits.

2. A liquid developing apparatus as defined in claim 1 wherein said supply openings are holes provided at intervals along said hollow pipe members.

3. A liquid developing apparatus as defined in claim 2 wherein each of said hollow pipe members is connected with a supply pipe at one end and is closed at the other end, and said supply openings are provided at changing intervals which increase from the supply pipe end to the closed end of each said hollow pipe member.

4. A liquid developing apparatus as defined in claim 1 wherein said supply openings are slits provided lengthwise of the hollow pipe members.

5. A liquid developing apparatus as defined in claim 1 wherein said developing head is electrically connected to a bias means.

6. A liquid developing apparatus as defined in claim 1 wherein said developing head has a cylindrically concave top surface extending at a constant distance from the surface of the latent image carrier.

7. A liquid developing apparatus as defined in claim 1 wherein said developing head has a flat top surface extending horizontally.

* * * * *